United States Patent [19]

Krautwurst

[11] 4,408,812

[45] Oct. 11, 1983

[54] DISMOUNTABLE FURNITURE

[76] Inventor: John Krautwurst, 67 Ingram Dr., Toronto, Canada, M6M 2L7

[21] Appl. No.: 172,554

[22] Filed: Jul. 28, 1980

Related U.S. Application Data

[63] Continuation-in-part of Ser. No. 30,846, Apr. 17, 1979, abandoned.

[51] Int. Cl.[3] ..... A47B 91/00; A47B 3/00

[52] U.S. Cl. ..... 312/256; 52/594; 108/107; 108/108; 108/111; 108/152; 312/111; 312/263; 312/245; 312/257; 403/231; 403/292

[58] Field of Search ..... 312/111, 108, 256, 263; 108/108, 109, 111, 152; 403/292, 409, 231, 384, 406; 52/594; 248/224.1; 46/26, 31; 220/23.4

[56] References Cited

U.S. PATENT DOCUMENTS

| | | | |
|---|---|---|---|
| 981,372 | 1/1911 | Brodt | 403/231 |
| 1,375,869 | 4/1921 | Vance | 108/109 |
| 2,287,454 | 6/1942 | Scharnberg | 403/292 |
| 2,363,405 | 11/1944 | Eichelberger | 403/409 |
| 3,031,782 | 5/1962 | Frye | 248/224.1 X |
| 3,033,635 | 5/1962 | Glass | 312/256 |
| 3,338,452 | 8/1967 | Oakley et al. | 220/23.4 |
| 3,547,472 | 12/1970 | Ehrman | 52/594 X |
| 3,636,558 | 1/1972 | Debaight | 46/26 |
| 3,770,135 | 11/1973 | Schild | 108/108 |
| 3,851,936 | 12/1974 | Muller | 312/111 |
| 3,881,829 | 5/1975 | James | 108/109 X |
| 3,994,408 | 11/1976 | Belitzky | 220/23.4 |
| 4,034,866 | 7/1977 | Beckwith | 403/231 X |
| 4,159,592 | 7/1979 | Grabriel | 46/29 |
| 4,165,852 | 8/1979 | Chervenak | 312/245 X |
| 4,203,373 | 5/1980 | Conti | 108/108 X |

FOREIGN PATENT DOCUMENTS

| | | | |
|---|---|---|---|
| 48636 | 1/1938 | France | 312/111 |
| 1208680 | 9/1959 | France | 108/8 |
| 1544144 | 9/1968 | France | 312/111 |
| 675927 | 7/1952 | United Kingdom | 108/108 |

*Primary Examiner*—James T. McCall

[57] ABSTRACT

Dismountable furniture comprising two or more vertical members, and a plurality of horizontal members, a plurality of upwardly directed V-shaped recesses formed in inwardly facing surfaces of said vertical members, a vertical end wall fastened to each end of each said horizontal member, a downwardly facing V-shaped recess formed in the outwardly facing surface of each said vertical end wall, and, at least two joining members, each said joining member having two generally V-shaped locking portions, having inner and outer sides, and being integrally joined between their inner sides, thereby locating said V-shaped locking members in spaced apart parallel planes, with their apices overlapping, and extending in opposite directions, with one of said V-shaped locking members being dimensioned to be received in one of said V-shaped recesses in said vertical members, and the other of said V-shaped locking members being dimensioned to be received in said V-shaped recess of said vertical end walls.

Also disclosed is dismountable furniture having two or more vertical members lying in a common plane, as in a wall or panel, and having a plurality of such upwardly directed V-shaped recesses formed in surfaces thereof, and at least one horizontal member having a vertical back wall, and there being at least two downwardly facing V-shaped recesses formed in the rear surface of said back wall, said upwardly and downwardly V-shaped recesses receiving two or more such joining members.

12 Claims, 17 Drawing Figures

50
52
14

60
58
54
56

12
20
44
22
40
58
14
58
22
54
12
22
58
14
52
50
54
58
14
22
12
20
14

60
58

56
54
60
58
15
15
50
14

52
13
13

DISMOUNTABLE FURNITURE

This application is a continuation-in-part of Appln. Ser. No. 030,846 filed Apr. 17, 1979, entitled "Dismountable Furniture"; now abandoned.

The invention relates to dismountable furniture, and in particular, to dismountable shelving and wall systems.

BACKGROUND OF THE INVENTION

Dismountable furniture, particularly shelving and wall systems, usually incorporate a plurality of vertical and horizontal panels, and some form of releaseably interlockable junction means. The success of the particular design turns almost entirely on the design of the junction means. In the majority of cases some form of metallic hardware is provided in the vertical members and in the horizontal members, so that the two may be interlocked. Usually, a tool such as a coin, or a simple screwdriver is required in order to rotate one or other or both of the locking means into a locked position.

In some such systems, the vertical members are made up in several sections, and each section is separated from the next section by means of a separate locking member, so that in fact each vertical member is a composite of two or even three such vertical sections.

A wide variety of different locking systems have been used in the past, but they have all exhibited various limitations. For example, in some cases the security of the locking system was inadequate, and the structure could never be made completely rigid. In other cases, particularly where a separate locking member is used between adjacent vertical portions, the shelving system exhibited relatively unsightly, or at least obvious, discontinuities in the vertical members which placed severe limitations on the type of furniture which could be designed using such a system. In other such locking systems, the design of the individual members was relatively costly, and also involved costly machining of the various vertical and horizontal members to accommodate the locking system.

Another and more fundamental disadvantage of most earlier systems is the fact that the locking devices must be manually tightened up before any articles such as books, papers, or art objects, tableware and the like, can be placed on the shelving. Once the shelves are loaded however it is a common experience that the locking devices then become somewhat loosened, or at least placed under different stresses, so that the entire furniture system becomes loosened. It is then necessary to attempt to retighten the various locking devices by hand. At this stage, however, such retightening is extremely different if not hazardous, and may mean removing a large portion of the contents of the furniture or shelving system.

Similarly, in the case of for example a book shelf, where books are repeatedly removed and replaced, the movement of the books may in itself lead to a gradual loosening or slackening of the locking system.

BRIEF SUMMARY OF THE INVENTION

The invention seeks to overcome the foregoing disadvantages, and comprises, in one embodiment, two or more vertical members, and a plurality of horizontal members, a plurality of upwardly directed V-shaped recesses formed in inwardly facing surfaces of said vertical members, a vertical end wall fastened to each end of each said horizontal member, a downwardly facing V-shaped recess formed in the outwardly facing surface of each said vertical end wall, and at least two joining members, each said joining member having two generally V-shaped locking portions, having inner and outer sides, and being integrally joined between their inner sides, thereby locating said V-shaped locking members in spaced apart parallel planes, with their apices overlapping, and extending in opposite directions, with one of said V-shaped locking members being dimensioned to be received in one of said V-shaped recesses in said vertical members, and the other of said V-shaped locking members being dimensioned to be received in said V-shaped recess of said vertical end walls.

In accordance with a particular feature of the invention, the V-shaped recesses are formed with inwardly under cut faces, and the V-shaped locking members are formed with correspondingly angled mating faces, such that when a said V-shaped locking member is placed in its corresponding V-shaped recess, and moved axially therein, a two dimensional wedging effect is achieved.

In accordance with a further advantageous feature of the invention, the vertical members are provided with a plurality of such V-shaped recesses, aligned along a central axis of such vertical members, each such recess joining with the next adjacent recesses at either end, whereby to provide a continuous elongated recess along the length of a major portion of such vertical member.

In a further form of the invention, the two or more vertical members may lie side-by-side in a common plane, as in a wall or panel, and a horizontal member such as a shelf may be supported therebetween, the horizontal member having a vertical back wall, thereby being upwardly and downwardly directed V-shaped recesses in respective vertical members and said vertical back wall, and there being at least two such connectors located therein, thereby supporting such a horizontal member on such a wall or panel.

The invention further comprises the provision of such joining members each such member having two generally V-shaped locking portions, having inner and outer sides, and being integrally joined between their sides, thereby located the V-shaped locking members in spaced apart parallel planes with their apices overlapping, and extending in opposite directions, said V-shaped locking members being designed and dimensioned to interfit and cooperate with suitable V-shaped locking recesses.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figures 1, 2:
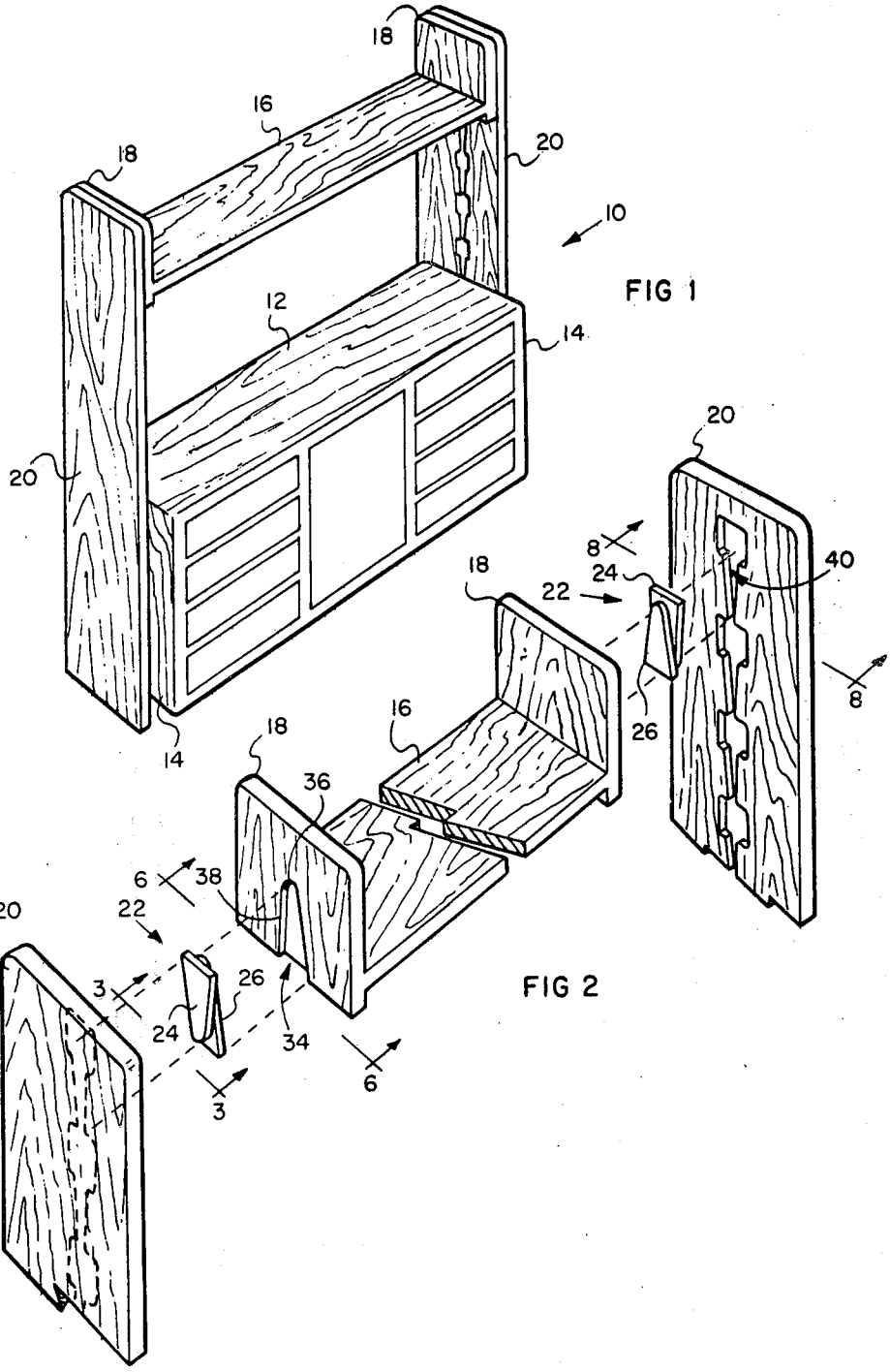
FIG. 1 is an upper front perspective illustration of a piece of furniture incorporating the invention.
FIG. 2 is an exploded perspective view of a shelf portion of the furniture of FIG. 1, partially exploded and cut-away.

Referring first of all to FIG. 1, the furniture illustrated there will be seen to comprise a simple form of combination cupboard, set of drawers, and a single shelf. Such a furniture item would for example be suitable for use as a simple form of dining room buffet, but might equally well be suitable for use in other locations. The invention is not to be taken as limited to any such a simple form of furniture, but will be readily understood to comprehend the construction of a variety of much more complex types of furniture, which may be multiple sets of shelves, for example book shelves, or may be combinations of shelves with cupboards, shelves with sets of drawers, or combinations of drawers, cupboards and desk units. Such different types of combinations of furniture are well known in the art and require no further description, and are not illustrated for the sake of clarity.

As shown specifically in FIG. 1, the furniture items shown generally as 10 comprise a storage unit 12, consisting of drawers and a centre cupboard, and provided with side walls 14. Above the storage unit 12, a shelf 16 is provided having end walls 18. Vertical side members 20 are provided, extending from the floor, up either side wall 14 of the storage unit 12, and alongside either end wall 18 of the shelf 16. It will of course be understood that such end members 20 might well be extended further upwardly to support further shelves if desired.

Referring in more detail to FIG. 2, the shelf 16 is shown partially cut-away, with the two vertical side members 20 shown separated from the end walls 18 of the shelf 16.

Figure 3:
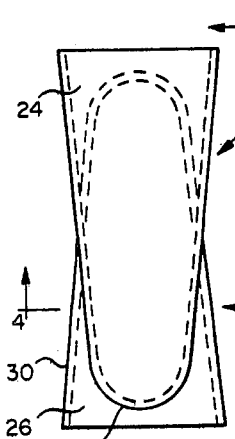
FIG. 3 is a front elevation of the joining member according to the invention.

In accordance with the invention, joining members shown generally as 22, are provided for uniting and fastening the end wall 18 of the shelving 16 to their respective vertical side members 20. Each of the joining members 22 are provided with two locking portions 24 and 26 respectively, shown in more detail in FIGS. 3,4 and 5.

Figure 4:
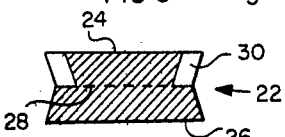
FIG. 4 is a section along the line 4—4 of FIG 3.
Figure 8:
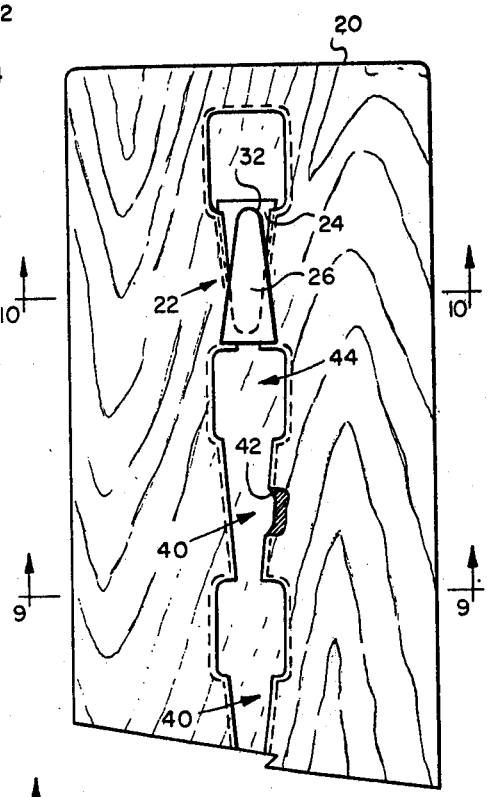
FIG. 8 is a side elevation from the direction of the line 8—8 of FIG. 2.

Each of the V-shaped portions 24 and 26 is of the same shape and construction, comprising outer surfaces (unnumbered) and a common interface 28, and generally V-shaped undercut side edges 30, and rounded apices 32. The undercut V-shaped side surfaces 30 are cut at a predetermined angle as shown in FIG. 4, so that they diverge outwardly with respect to the common interface 28.

The apices 32 are directed in opposite directions, and overlap one another as shown.

The two V-shaped members 24 and 26 are integrally joined at their interface 28, so that they effectively form a single structure.

In fact, in the preferred case, the two v-shaped members 24 and 26 will be machined out of a single piece of hardwood, so that the interface 28 is somewhat of a notional concept. It will however, be appreciated that the two members could equally well be made separately and joined with glue for example at such interface 28, which would effectively make the same integral one piece structure.

For the purposes of this description therefore reference to the interface 28 is deemed to include both a two part construction and also construction of a single piece of material.

Figure 5:
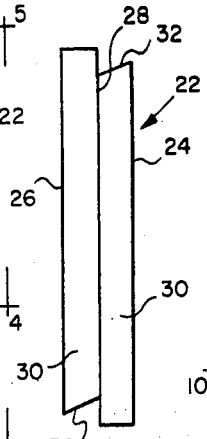
FIG. 5 is a side elevation of the item of FIG. 3.

As shown in FIGS. 4 and 5, the two V-shaped members 24 and 26 are located in spaced apart parallel planes.

Figure 6:
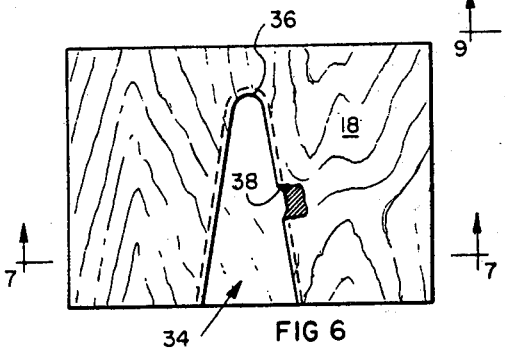
FIG. 6 is an end elevation taken along the line 6—6 of FIG. 2.
Figure 7:
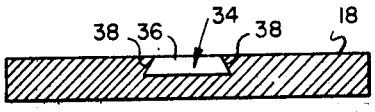
FIG. 7 is a section along the line 7—7 of FIG. 6.
Figure 9:
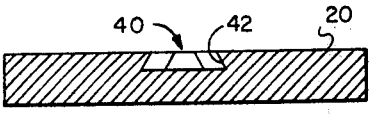
FIG. 9 is a section along the line 9—9 of FIG. 8.
Figure 10:
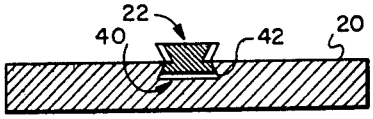
FIG. 10 is a section along the line 10—10 of FIG. 8.

As best shown in FIGS. 2, 6 and 7, the end walls 18 of the shelving 16 are provided, in their outwardly facing surfaces, with downwardly directed open ended V-shaped recesses 34, having a closed restricted end 36, and the lower open end being open.

V-shaped recess 34 is provided with generally converging V-shaped side walls 38 which are inwardly undercut as shown in FIG. 7. The undercutting of side walls 38, and the dimensions are such that they will snugly receive one of the locking members 24 or 26 therein, and, when such locking member is tapped home for example with a mallet or other tool, a two dimensional wedging effect is achieved, both by the co-operation of the V-shaped recess with the V-shaped locking member, and also by co-operation between the undercut side edges 38, and the undercut side surfaces 30.

As best shown in FIGS. 2, 8, 9 and 10, the vertical side members or support members 20 are provided with generally similar upwardly directed open ended V-shaped recesses 40, having undercut side edges 42, dimensioned to receive the undercut side edges of the other of locking members 24 or 26, in a two dimensional wedging fashion. It will of course be appreciated that the locking members 24 and 26 in this embodiment of the invention are of identical dimensions and shape, so that the V-shaped recesses 34, in the end members 18, and the V-shaped recesses 40 in the vertical support members 20 are also of the same dimensions, so that the locking mechanism 22 may be used interchangably, either way around.

It is not however, absolutely essential to the objects of the invention that this should be made in this manner. The V-shaped recesses 40 could be either larger or smaller than the recesses 34, in which case the locking members 22 would have to be made with the two locking portions 24 and 26 of a different dimension corresponding to the particular V-shaped recesses.

It will be noted that the vertical support members 20 are provided with a plurality of spaced apart V-shaped recesses 40, in axial alignment therealong, along their inwardly directed faces, their outwardly directed faces being smooth and free of such formations.

In order to facilitate the introduction and removal of the locking members 22, the V-shaped recesses 40 are connected by means of generally rectangular openings or recesses 44, extending between the broad or wider end of one V-shaped recess 40 and the narrower end of the next uppermost V-shaped recess 40. In this way, the locking member 22 can easily be placed in position by placing it in the recess 44, and then simply sliding it downwardly so that either the locking portion 24 or 26 slides into the V-shaped recess 40. If desired if may be tapped into position with a mallet or similar tool.

The shelf unit 16 can then be attached to it simply by placing the V-shaped recess 34 of the end member 18 in position against the inwardly directed face of the vertical support member 20, above the locking member 22 and then simply sliding it downwardly, so that the other of the locking portions 24 or 26, i.e. that portion which is extending outwardly from the side member 20, then enters the V-shaped recess 34. Again if desired it can be tapped into position with the mallet.

The same operations are then carried out for the other of the vertical support members 20 and the other end member 18, and the shelf 16 will then be securely fastened into position.

It is to be noted that once the shelf 16 is loaded with a weight, i.e. books, art objects and the like, it will not have a loosening effect on the fastening between the end members 18 and the vertical side members 20. Instead, the greater the load, the tighter will be the wedging action, and the more the end members 18 will be drawn firmly into contact with the inner faces of the vertical side members 20.

It will of course be appreciated that a book case can be created simply by erecting two or more such shelves 16 in position between two end members 20.

However, as shown in the embodiment of FIG. 1, a much larger storage unit 12 can be fastened into position in the same way. The details of this are shown in FIGS. 11 to 15.

In this case the storage unit 12, which may be as stated above a variety of different types of furniture, will in any event have side or end panels 14. Such side or end panels 14 perform essentially the same function as the side or end panels 18 of the shelf unit 60. The end panels 14 are provided with oversized V-shaped notches 50, having undercut side edges 52, and being open at their lower wider ends and closed at their upper narrower ends.

Figures 11, 12, 13, 14, 15:
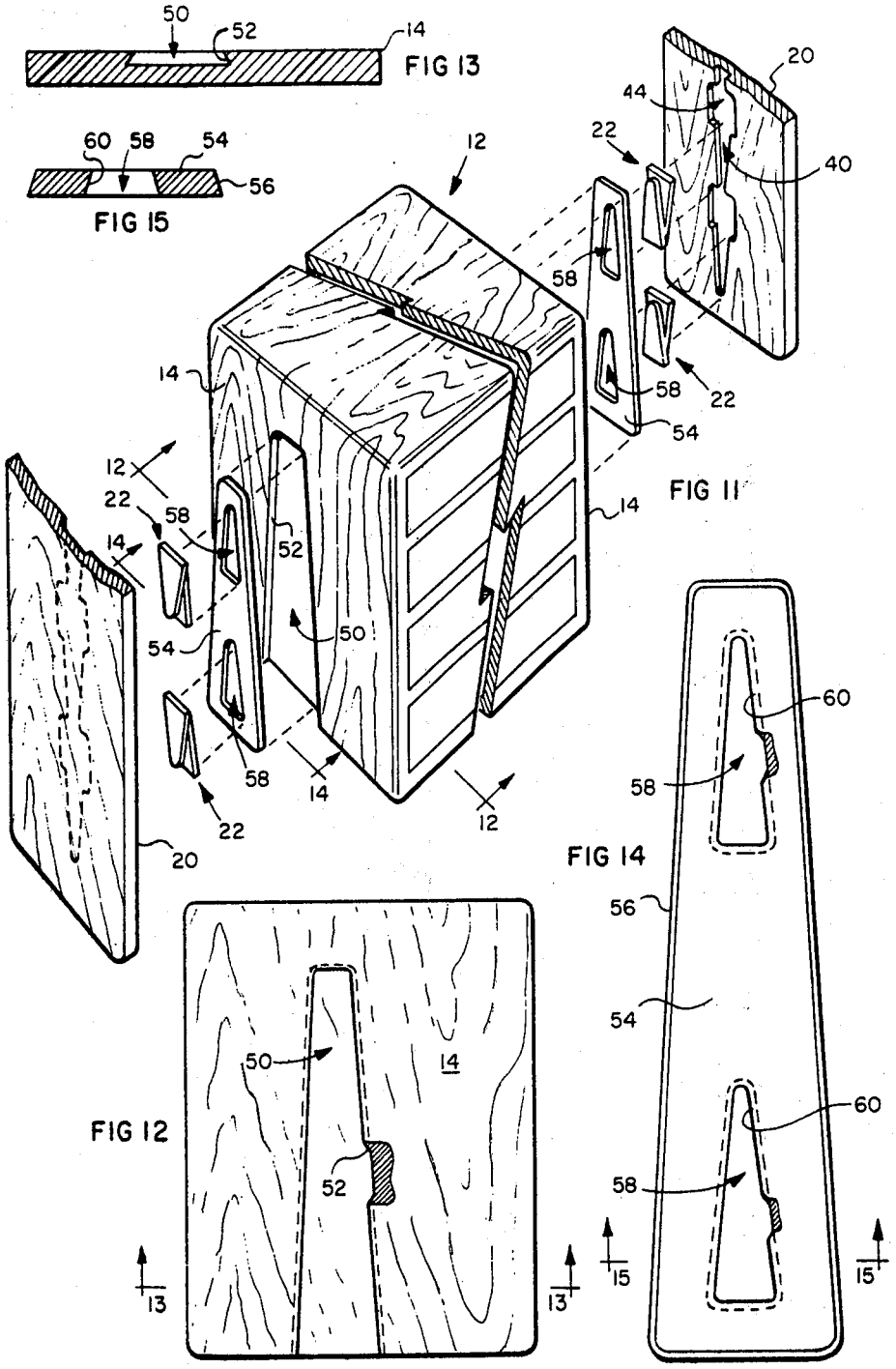
FIG. 11 is an exploded partially cut-away perspective view of the lower portion of the furniture item shown in FIG. 1.
FIG. 12 is a side elevation taken along the line 12—12 of FIG. 11, partially cut-away.
FIG. 13 is a section along the line 13—13 of FIG. 12.
FIG. 14 is a side elevation of a portion of the furniture structure shown in FIG. 11, shown along the line 14—14.
FIG. 15 is a section along the line 15—15 of FIG. 14.

In order to support the full weight of the drawer or other unit 12, it has been found desirable to use two locking members 22 one above the other, as shown in FIG. 11. For this purpose, an adapter plate 54 is provided, being of generally four sided shaped, two tapering side walls 56 which are angled so as to make it a good wedging fit with the undercut side walls 52 of the V-shaped notch 50.

Two smaller V-shaped notches 58 are provided within the adapter plate 54, having inwardly undercut V-shaped side walls 60 with a narrower portion directed upwardly.

The V-shaped notches 58 are spaced vertically apart along the length of the plate 54 so as to register with two of the V-shaped notches 40 of the side supports 20. The side walls 60 are spaced and dimensioned so as to make a good wedging fit with the locking members 22 in the same way as described above.

It will thus be seen that the drawer units 12 will be supported by two spaced apart locking members 22 on either side, through the use of the adapter plate 54 and the oversized V-shaped notches 50 in end walls 14.

In this way, the end walls 14 of the drawer unit 12, when supported on the locking members 22, will be drawn tightly into engagement with the inner surfaces of the end members 20, and will make a good solid joint, and at the same time provide a pleasing appearance.

The operation of the invention is self-evident. The wooden connector members and the adapter plates are first of all assembled in association with the drawer unit 12 and the two side members are then joined by means of the connector member.

The further connector members and the shelf unit 16 is then placed in position.

In each case, the only assembly operation that is required is simply achieved by hand, and the final locking of the parts can be achieved by a light tap with a wooden mallet. In many cases, even this last locking function will be unnecessary since as the shelves and draws are filled with contents, they will progressively lock tighter into position.

The interengagement of the V-shaped locking members, in their recesses, support the weight on the shelves, drawers, etc., and the undercut edges procure a lateral wedging action drawing the vertical members tightly against the end members of the shelves, drawers etc., and thus prevent any tendency of the vertical members to sway or swing.

It will be readily understood that if a larger piece of furniture, ie., having several bays or sections is desired, then some vertical members may be simply glued or fastened back to back. Alternatively, if the wood is thick enough, V-shaped recesses can be formed in both sides, so that shelving etc., can be supported on both sides.

The invention described above, has been illustrated by way of example in use in association with the type of furniture which is designed as a free standing structure in a room.

It will however be appreciated that the invention is equally applicable to the construction of for example shelving or other support systems which form an integral part of the wall, or which are permanently attached to the wall as for example with screws.

Figure 16:
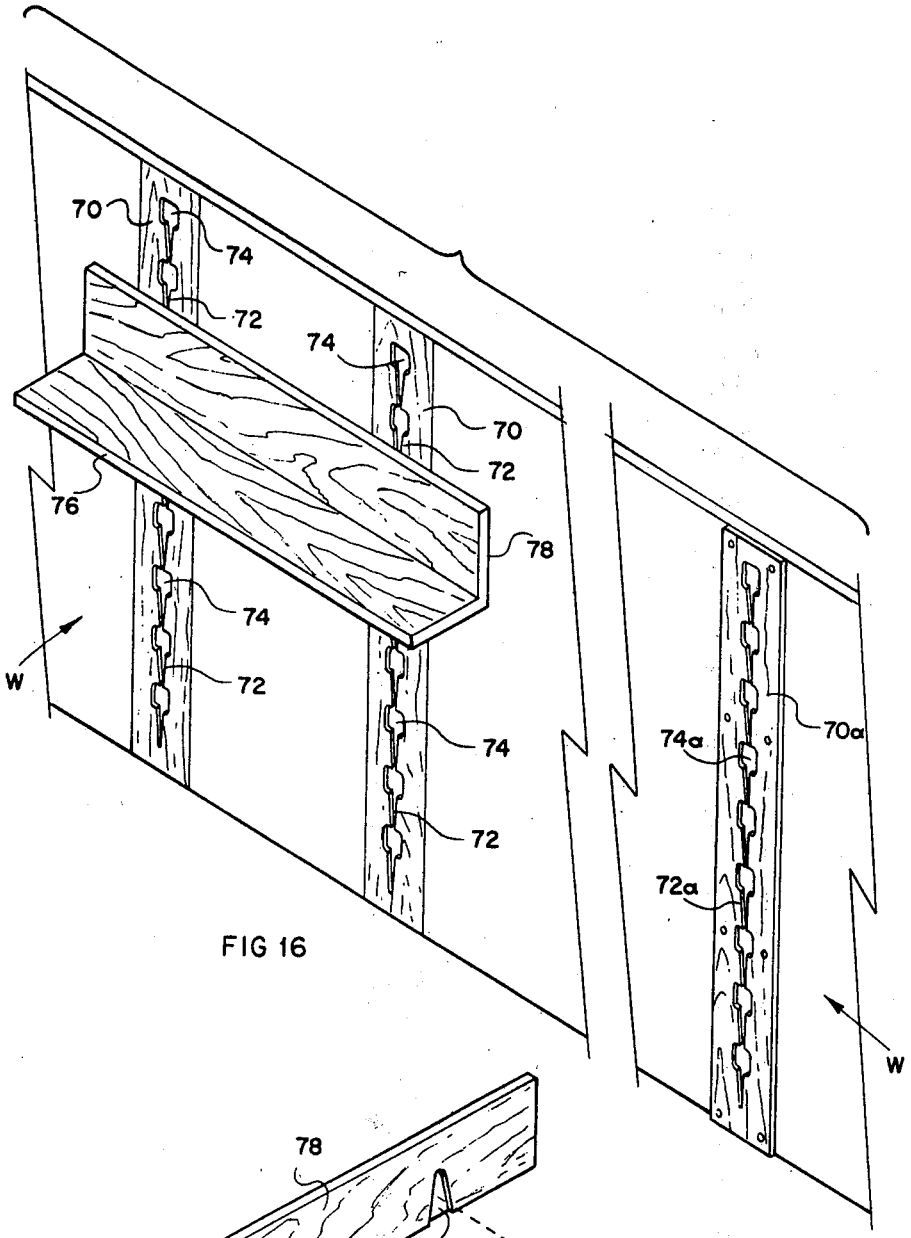
FIG. 16 is a perspective illustration of an alternate form of the invention, and, FIG. 17 is an exploded rear view of the horizontal shelf portion of FIG. 16.
Figure 17:
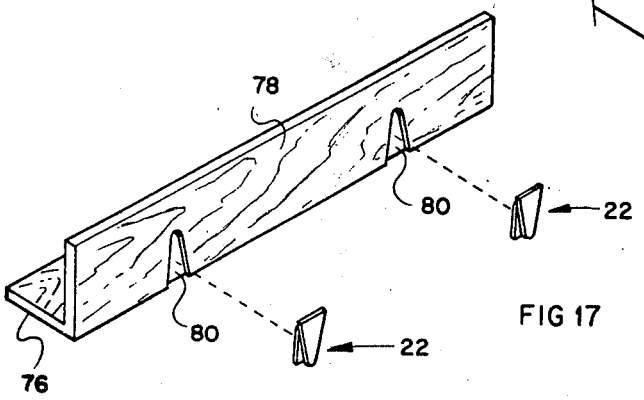

As best shown in FIGS. 16 and 17, a wall W is illustrated in which a plurality of vertical members form an integral part of the wall structure itself. While they are illustrated as being built into the wall W, it will of course be appreciated that the wall W may simply consist of a large flat panel which may be fastened to a wall.

In either case, the support members 70, whether as separate structures, or whether as an integral part of the wall, will incorporate a plurality of V-shaped recesses 72 formed with undercut side walls in the same manner as described above, and interconnected by means of generally open rectangular areas 74.

As a further alternative form of the invention, the member **70*a*, may be manufactured as a separate structure, and fastened to a wall W by means such as wood screws, wall plugs, anchors, or the like. Members 70*a* would also be provided with V-shaped recesses 72*a* and rectangular openings 74*a***.

In either case, the members 70 or **70*a* are designed to cooperate with horizontal members such as the shelf 76. Shelf 76 has a vertical support member namely a back wall 78 having a sufficient width to span the spacing of at least two such vertical members 70 or 70*a*. Back wall 78 is provided with at least two such downwardly directed V-shaped recesses 80, the spacing between V-shaped recesses 80 corresponding between the spacing between V-shaped recesses 72 in any two adjacent such vertical members 70. The same joining members 22, as described above, are employed in the recesses 80 and the recess 72, to provide support for the shelves 76**.

While the alternate forms of invention as shown have been illustrated merely in connection with a structure such as a shelf 76, it will be appreciated that reference to horizontal members throughout the specification and claims is intended to indicate any such structure which may be supported whether it be a shelf or a cupboard or a desk, or any other typical furniture unit as is known in the art.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. Dismountable furniture comprising; at least two vertical members;

a plurality of horizontal members;

a vertical end wall attached to each end of each said horizontal member;

a plurality of upwardly directed V-shaped recesses formed in inwardly facing surfaces of said vertical members;

a downwardly facing V-shaped recess formed in the outwardly facing surface of each said vertical end wall of each said horizontal member, and, at least two joining members, each said joining member having two generally V-shaped locking portions, having inner and outer sides, and being integrally joined between their inner sides thereby locating said V-shaped locking members in spaced apart parallel planes, with their apices overlapping and extending in opposite directions, with one of said V-shaped locking members being dimensioned to be received in one of said V-shaped recesses in said vertical members, and the other of said V-shaped locking members being dimensioned to be received in said V-shaped recess of said vertical end walls, whereby said horizontal members may be supported between said vertical members, by interlocking engagement of said V-shaped locking members.

2. Dismountable furniture as claimed in claim 1 wherein said V-shaped recesses are formed with inwardly undercut faces, and the V-shaped locking members are formed with corresponding angled mating faces, such that when a said V-shaped locking member is placed in its corresponding V-shaped recess and moved axially therein a two dimensional wedging effect is acheived.

3. Dismountable furniture as claimed in claim 1 wherein said vertical members are provided with a plurality of such V-shaped recesses aligned along a central axis of such vertical member, and including joining recess means, joining said V-shaped recesses whereby to provide a continuous elongated irregular recess along the length of a major portion of such vertical member.

4. Dismountable furniture as claimed in claim 1, wherein said horizontal members comprise shelves.

5. Dismountable furniture as claimed in claim 3, wherein at least some of said horizontal members comprise one or more storage units such as a drawer unit or the like.

6. Dismountable furniture as claimed in claim 5, including elongated V-shaped recesses formed in vertical end walls of said storage unit, generally V-shaped insert portions, dimensioned to be received within said V-shaped recesses, and being removeably insertable therein, at least two vertically spaced V-shaped recesses formed in each said insert portion, each of said V-shaped recesses being dimensioned and adapted to receive a said V-shaped locking member therein, with said spaced apart V-shaped recesses registering with respective spaced apart recesses in said vertical members.

7. Dismountable furniture comprising;

at least two vertical members;

at least one horizontal member adapted to extend between said vertical members;

vertical mounting wall means attached to said horizontal member;

a plurality of upwardly directed V-shaped recesses formed in surfaces of said vertical members;

at least two downwardly facing V-shaped recesses formed in said vertical mounting wall means, and, at least two joining members, each said joining member having two generally V-shaped locking portions, having inner and outer sides, and being integrally joined between their inner sides, thereby locating said V-shaped locking members in spaced apart parallel planes, with their apices overlapping and extending in opposite directions, with one of said V-shaped locking member being dimensioned to be received in one of the V-shaped recesses in said vertical members, and the other of said V-shaped locking members being dimensioned to be received in said V-shaped recess of said vertical wall means, whereby said horizontal member may be supported between said vertical members, by interlocking engagement of said V-shaped locking members.

8. Dismountable furniture as claimed in claim 7 wherein said V-shaped recesses are formed with inwardly undercut faces, and the V-shaped locking members are formed with corresponding angled mating faces, such that when a third V-shaped locking member is placed in its corresponding V-shaped recess and moved axially therein, a two dimensional wedging effect is achieved.

9. Dismountable furniture as claimed in claim 7 wherein said vertical members are provided with a plurality of such V-shaped recesses aligned along a central axis of such vertical member, and including joining recess means, joining said V-shaped recesses whereby to provide a continuous elongated irregular recess along the length of a major portion of such vertical member.

10. Dismountable furniture as claimed in claim 7 wherein said horizontal members comprise shelves.

11. Dismountable furniture as claimed in claim 1 wherein at least one of said horizontal members comprise one or more storage units such as a drawer unit or the like.

12. A joining member for joining two furniture members, wherein each said furniture member has a V-shaped recess formed therein, one of said V-shaped recesses being directed upwardly and the other of said V-shaped recesses being directed downwardly, said joining member comprising;

two generally V-shaped locking portions having inner and outer sides, and being integrally joined between their inner sides thereby locating said V-shaped locking members in spaced apart parallel planes with their apices overlapping and extending in opposite directions, with one of said V-shaped locking members being dimensioned to be received within one of said V-shaped recesses, and the other of said V-shaped locking members being dimensioned to be received in the other of said V-shaped recesses whereby said furniture members may be interlocked by engagement of said V-shaped locking members.

* * * * *